US005335717A

United States Patent [19]

Chin et al.

[11] Patent Number: 5,335,717

[45] Date of Patent: Aug. 9, 1994

[54] OXIDATION RESISTANT SUPERALLOY CASTINGS

[75] Inventors: Stephen Chin, Wallingford; Donald R. Parille, South Windsor, both of Conn.; Paul R. Aimone, Muskegon, Mich.; Robert L. McCormick, N. Muskegon, Mich.; Paul R. Johnson, Whitehall, Mich.; Bart M. Kilinski, Montague, Mich.

[73] Assignees: Howmet Corporation, Greenwich; United Technologies Corporation, Hartford, both of Conn.

[21] Appl. No.: 828,206

[22] Filed: Jan. 30, 1992

[51] Int. Cl.[5] ..... B22C 1/02

[52] U.S. Cl. ..... 164/519; 164/122.1; 164/122.2

[58] Field of Search ..... 164/519, 529, 122.1, 164/122.2

[56] References Cited

U.S. PATENT DOCUMENTS

| | | | |
|---|---|---|---|
| 1,438,693 | 12/1922 | Bowker . | |
| 2,594,998 | 4/1952 | Rocco . | |
| 3,450,189 | 6/1969 | MacDonald . | |
| 3,722,574 | 3/1973 | Anderson et al. . | |
| 3,815,658 | 6/1974 | Schneider . | |
| 4,102,689 | 7/1978 | Borom | 164/529 |
| 4,140,555 | 2/1979 | Garcia et al. . | |
| 4,878,965 | 11/1989 | Gostic et al. . | |
| 4,891,183 | 1/1990 | Corwin . | |
| 4,947,926 | 8/1990 | Ogino et al. . | |

FOREIGN PATENT DOCUMENTS

| | | | |
|---|---|---|---|
| 3825250 | 2/1989 | Fed. Rep. of Germany | 164/529 |
| 60-12247 | 1/1985 | Japan | 164/519 |
| 1426125 | 2/1976 | United Kingdom . | |

OTHER PUBLICATIONS

"Melting Process and Solidification in Alloys 718–625", A. Mitchell, pp. 16–25, The Minerals, Metals and Materials Society, 1991.

*Primary Examiner*—Kuang Y. Lin

*Attorney, Agent, or Firm*—Flynn, Thiel, Boutell & Tanis

[57] ABSTRACT

The oxidation resistance of a superalloy casting such as an equiaxed, directionally solidified, or single crystal casting, is improved by melting, pouring, or casting the alloy so as to react with a magnesium or calcium-bearing ceramic material. Magnesium or calcium is introduced into the alloy through a controlled reaction between the alloy and the magnesium or calcium-bearing ceramic material.

22 Claims, 15 Drawing Sheets

200X

Bar #2

200X

Bar #1

Bar #4 200X

Bar #3 200X

Bar #6 200X

Bar #5 200X

Bar#8 200X

Bar#7 200X

Bar*9 200X

OXIDATION RESISTANT SUPERALLOY CASTINGS

FIELD OF THE INVENTION

The present invention relates to a method of casting a superalloy in a manner to improve the oxidation resistance of the resultant casting without degrading casting quality.

Background of the Invention

With the next generation of gas turbine engines expected to operate at metal temperatures exceeding 2100° F., oxidation resistance of the turbine components, such as blades and vanes, will become increasingly important. Nickel and cobalt base superalloys have been developed that rely on the formation of a protective, adherent alumina surface scale to impart surface stability (i.e., resistance to oxidation) to the blades/vanes in the hot section of a turbine engine. However, as a result of repeated thermal cycles during typical engine operation, the scale is subjected to thermal stresses which tend to cause the scale to spall. In addition, tramp elements such as sulfur and phosphorous in the alloy segregate to the scale/metal interface where they render the scale more susceptible to spallation during service in the turbine environment.

The nickel base superalloys of interest are primarily alumina scale formers. One approach to reduce alumina scale spallation involves the addition of rare earth elements, such as yttrium, to the superalloy compositions (e.g. >500 ppm by weight in the alloy) as described in various technical journals. The yttrium ties up sulfur, phosphorous and other tramp elements at the scale/base metal interface, and in the bulk alloy, as stable innocuous compounds. Unfortunately, the addition of such high yttrium levels to the superalloy substantially increases alloy reactivity with the foundry ceramics employed in the melting and casting of turbine blades and vanes. Alloy reactivity is increased to the point that alloy castability and surface quality are substantially degraded. Yttrium additions contribute to increased dross formation in superalloy melts and castings through reaction with crucible and mold ceramics which also can cause pronounced chemical variations and depletion of yttrium in thin walled castings. Yttrium additions also can increase the eutectic volume fraction in such alloys. The effects of alloy reactivity and chemical variations can be minimized by the use of special, but expensive foundry ceramics with a substantial cost increase to the final casting.

Magnesium is known to tie up sulfur and other tramp elements, improve forgability and alter carbide morphology when present in superalloy compositions as described in U.S. Pat. No. 4,140,555. However, elemental additions of magnesium to superalloys are very difficult to control. Due to its high vapor pressure (greater than 1 atmosphere at typical casting temperatures), magnesium readily volatilizes from superalloy melts. Under vacuum conditions and with as little as 300 to 600 ppm magnesium present in the alloy, magnesium volatilization is violent enough to blow significant amounts of molten alloy out of the remelt crucible. In addition, the rapid volatilization of magnesium produces alloy chemistry control problems similar to those encountered with elemental yttrium additions.

SUMMARY OF THE INVENTION

The present invention involves a method of improving the oxidation resistance of a nickel, cobalt, nickel/cobalt or iron base superalloys, such as equiaxed, directionally solidified, or single crystal castings, without degrading alloy castability or casting quality. In one embodiment, the method of the invention involves reacting the superalloy in the molten state with a magnesium-bearing ceramic material, preferably comprising magnesia, so as to enhance the oxidation resistance of the casting when the alloy is subsequently solidified. Preferably, the molten superalloy is cast into a mold having a facecoat and/or core material that comprises the magnesium-bearing ceramic. Reaction between the molten alloy and the magnesium-bearing ceramic material introduces a small concentration of magnesium into the superalloy. Magnesium introduced into the superalloy in this manner improves oxidation resistance without degrading alloy castability or casting quality. As a result, the superalloy may be substantially free of yttrium and other rare earth elements heretofore included in the alloy composition to improve oxidation resistance.

The present invention is especially useful, although not limited to, superalloy castings produced by equiaxed, directional solidification, and single crystal processes where there is a relatively long residence time of the melt in the mold.

In accordance with a working embodiment of the invention, a casting mold is prepared using the lost wax practice wherein a fugitive pattern, such as a wax pattern, of the article to be cast is alternately dipped in ceramic slurry, stuccoed with ceramic particles and then dried. This sequence is repeated to build a shell mold about the pattern. The pattern may or may not contain a magnesium-bearing core material. At least one of the slurry and stucco layers contains magnesia as a major constituent thereof to form a shell mold facecoat for reacting with the alloy during the subsequent casting operation. A reaction barrier coat or layer, typically comprising a non-reactive second or third layer (e.g., alumina slurry/alumina stucco), is applied to the magnesia bearing facecoat. Then, additional slurry and stucco back-up layers typically are applied to provide a shell mold of desired wall thickness and strength. The pattern is thereafter removed from the shell mold by methods familiar to those skilled in the art of investment casting.

Preparatory to casting, the shell mold is subjected to successive elevated temperature preheats. A charge of the superalloy is melted, cast into the mold, and solidified in accordance with a desired solidification regime that typically may include known directional solidification (DS) or single crystal solidification (SC) processes. While the molten superalloy is solidifying in the mold, magnesium is introduced into the alloy composition by a controlled reaction between the molten alloy and the magnesia-bearing mold facecoat or core.

Typically, between approximately 10 to 30 ppm or more (e.g., 50 ppm) of magnesium is introduced into the alloy composition. The introduced magnesium is effective in improving the oxidation resistance of the resultant casting to a level at least comparable to that of the same superalloy base composition having a high concentration of yttrium therein. This improvement in oxidation resistance is achieved without experiencing the above-described alloy castability, casting quality, and cost problems associated with yttrium-containing alloys or the use of expensive foundry ceramics. Moreover, a wide variety of casting shapes and sizes can be treated in accordance with this embodiment of the invention since the magnesia-bearing mold facecoat can be readily fabricated to myriad shapes and sizes.

In an embodiment of the invention for making an oxidation resistant, nickel base superalloy having a single crystal microstructure, a casting mold is prepared to comprise a plurality of slurry layers and stucco layers wherein at least one of the layers contains magnesia. The superalloy is melted and then poured into the mold such that the melted superalloy reacts with magnesium in the magnesia layer in a manner that the superalloy becomes enriched with magnesium. The magnesium enriched superalloy is solidified in the mold at a rate sufficient to produce a single crystal superalloy.

In a preferred embodiment of the invention, a superalloy is melted in a crucible comprising a magnesium-bearing ceramic, preferably magnesia, and is then cast into a mold having the magnesium-bearing facecoat, preferably magnesia, for subsequent equiaxed, directional, or single crystal solidification therein.

These and other advantages of the present invention will become more apparent from the following detailed description and drawings.

DETAILED DESCRIPTION OF THE INVENTION

Figure 1:
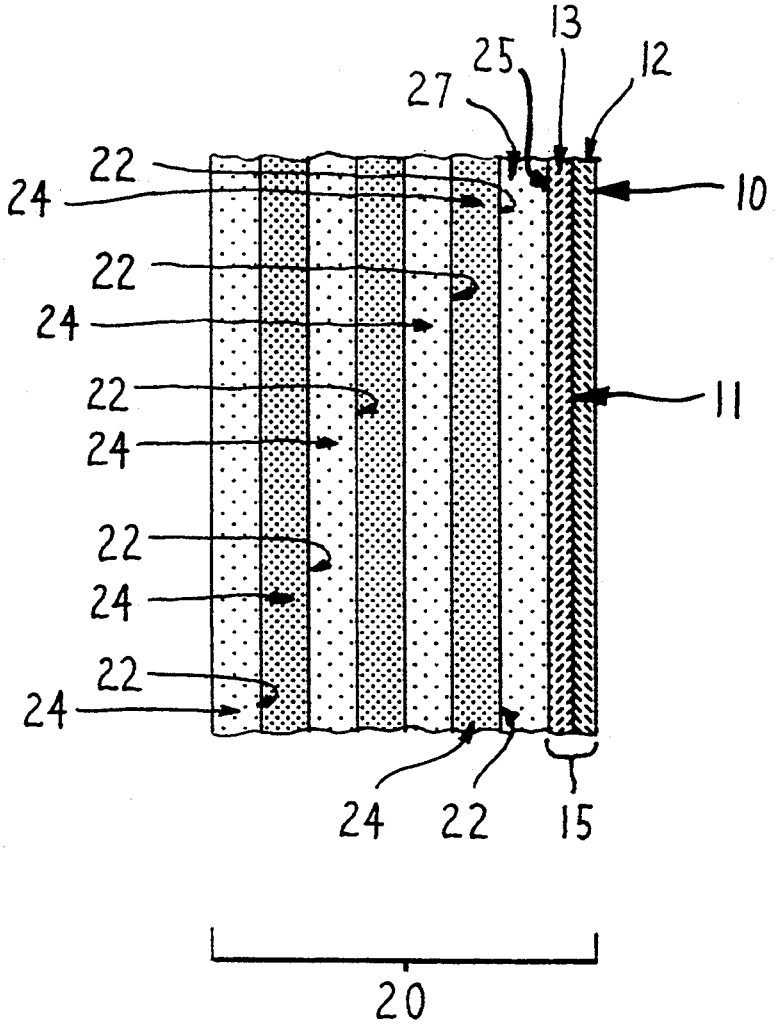
FIG. 1 is a schematic sectional view of a portion of the wall of the casting mold used in practicing one embodiment of the invention. This figure illustrates the magnesium-bearing facecoat and other mold coats or layers applied thereon.

The present invention is useful, although not limited to, the casting of nickel, cobalt, nickel/cobalt, and iron based superalloys by equiaxed, directional, and single crystal solidification processes wherein there is a relatively long residence time of the superalloy melt in the casting mold. The directional solidification and single crystal solidification processes, described in such patents as U.S. Pat. Nos. 1,438,693 and 2,594,998, are currently used for commercial casting of gas turbine engine components. For purposes of illustration only, the present invention will be described hereinafter in connection with the casting of a specific nickel based superalloy nominally comprising, by weight, 10% Co, 8.7% Ta, 5.9% W, 5.7% Al, 5% Cr, 3% Re, 1.9% Mo and 0.1% Hf and the balance essentially Ni. This superalloy composition is referred to hereafter in the detailed description as the baseline superalloy. A similar baseline superalloy composition with a 2000 ppm (parts per million by weight) yttrium addition is currently used in casting single crystal turbine blades. As mentioned hereinabove, yttrium is added to the baseline superalloy composition to improve the oxidation resistance of single crystal castings. However, as described hereinabove, the addition of yttrium to the baseline superalloy degrades alloy castability, casting quality and increases casting costs. The yttrium-bearing baseline superalloy composition is referred to hereafter as the Y-bearing superalloy.

In accordance with the present invention, the oxidation resistance of castings having compositions such as the aforementioned baseline superalloy composition, especially as DS and SC castings, is improved to a level comparable to or better than that of a Y-bearing superalloy casting while avoiding the problems described above, such as degradation in alloy castability and casting quality experienced with the Y-bearing superalloy. By practicing the present invention, a small quantity of magnesium is introduced into the superalloy casting through a controlled reaction of the molten alloy with a magnesium-bearing ceramic material. The reaction between the molten superalloy and the ceramic material is effective in introducing magnesium to the superalloy in sufficient concentration to improve oxidation resistance without degrading other essential alloy properties. Typically, magnesium concentrations in the casting in the range of at least 10 to about 30 parts per million by weight, or more (e.g., 50 ppm) have been found to be effective in improving the oxidation resistance of the baseline superalloy castings to a level comparable to or better than that of the Y-bearing superalloy castings.

The magnesium-bearing ceramic material may comprise magnesia (MgO), magnesium silicate ($MgSiO_3$), magnesium aluminate ($MgAl_2O_4$), magnesium zirconate and possibly other magnesium-bearing ceramic compounds, mixtures or solid solutions. The invention will be described in detail below with respect to the use of magnesia as the magnesium-bearing ceramic material since magnesia is preferred in practicing the invention.

In accordance with one embodiment of the invention, the baseline superalloy is cast into a mold having a facecoat comprising magnesia. This embodiment is advantageous to effect the desired introduction of magnesium into superalloy castings having a wide variety of shapes and sizes since the mold surrounds and encloses the superalloy melt during solidification. It is also advantageous in that any sulfur picked up by the superalloy during the melting or casting operations can be rendered innocuous at the final solidification stage via reaction of the molten superalloy and the mold facecoat.

FIG. 1 illustrates a section through a typical shell mold prepared in accordance with the lost wax practice. The mold is made from a fugitive pattern (not shown), such as a wax pattern which may or may not include a magnesium-bearing core, that is alternately dipped in ceramic slurry, stuccoed with ceramic particles and then dried in repeated fashion to build a shell mold about the pattern. The combination of the first slurry layer 10 and the first stucco layer 12 produces a facecoat 15 of the shell mold 20 for contacting the melt. The facecoat 15 may, but is not required to, include a second slurry layer 11 and a second stucco layer 13. The facecoat 15 is backed by additional slurry/stucco layers 22,24 in a manner typical to shell mold production. To eliminate facecoat melting or undesired reactions with the facecoat, a barrier layer should be present between the magnesia bearing facecoat 15 and the backup layers 22,24. The barrier layer preferably comprises an alumina based slurry 25 and alumina stucco 27 (described below). Subsequent backup slurry/stucco layers may be comprised of any conventional ceramic based system suitable for the shell mold.

Various mold facecoat materials were used to evaluate the effect of facecoat composition on alloy composition (i.e., Mg enrichment), casting oxidation resistance and quality of single crystal castings of the baseline superalloy. The various facecoat compositions evaluated are listed in Table 1.

TABLE 1

"RAINBOW" MOLD SLURRY/STUCCO COMBINATIONS

| TEST BAR NUMBER | FACECOAT SLURRY | FACECOAT STUCCO |
|---|---|---|
| 1 | $ZrSiO_4$ | $Al_2O_3$ |
| 2 | $ZrSiO_4$ | MgO |
| 3 | $ZrSiO_4$ | $Y_2O_3$ |
| 4 | MgO | $Al_2O_3$ |
| 5 | MgO | MgO |
| 6 | MgO | $Y_2O_3$ |
| 7 | $Y_2O_3$ | $Al_2O_3$ |
| 8 | $Y_2O_3$ | MgO |
| 9 | $Y_2O_3$ | $Y_2O_3$ |

A "rainbow" casting mold incorporating these facecoat compositions was fabricated in the following manner:

Mold Preparation

Cylindrical patterns of 6 inches length were cut from 0.5 inch diameter wax bar stock. Single crystal starters and gating sections were attached to the patterns to form subassemblies (i.e., bar pattern with attached starter and gating section). Three individual subassemblies were then dip coated with a zircon slurry (78 weight % zircon particles of −325 mesh in colloidal silica binder) followed by stuccoing with either alumina, magnesia, or yttria sands (all 120 mesh size). Three additional subassemblies were dipped in a magnesia based slurry (80 weight % magnesia particles of −325 mesh in ethyl silicate binder) and stuccoed with either alumina, magnesia, or yttria sands (all 120 mesh size). Three additional subassemblies were dipped in a yttria slurry (84 weight % yttria particles of −325 mesh in colloidal silica binder) followed by stuccoing with either alumina, magnesia, or yttria sands (all 120 mesh size). The first slurry/stucco layer 10,12 (see FIG. 1) of these pattern assemblies was then dried. The total thickness of the first slurry/stucco layer was approximately 0.016 to 0.030 inch.

Each of these subassemblies then was coated with a second slurry/stucco layer 11,13 (see FIG. 1) comprising either alumina, magnesia or yttria using the same dipping/stuccoing/drying procedures and materials (i.e. slurry and stucco materials) described above to provide the facecoat compositions/structures listed in Table 1 hereinabove. The total thickness of the second slurry/stucco layer was approximately 0.0 to 0.030 inch.

After the individual pattern assemblies we coated with the different facecoats, they were combined into a "rainbow" mold pattern assembly. The "rainbow" mold pattern assembly was then invested with eight (8) back up slurry/stucco layers using the dipping/stuccoing/drying procedures described above for the mold facecoat. Each layer of slurry/stucco was allowed to dry before the next layer was applied. The third and seventh backup slurry/stucco layers were comprised of the alumina slurry (about 80 weight % $Al_2O_3$ particles of −325 mesh in colloidal silica binder) and an alumina stucco (−28+48 mesh size). The sixth and eighth backup slurry/stucco layers were comprised of the aforementioned zircon slurry and an alumina stucco (particles −14+28 mesh size). The fourth and fifth backup slurry/stucco layers comprise the zircon slurry and alumina slurry, respectively, and graphite stucco (particles −14+28 mesh size) to aid in degassing the mold. After the eighth slurry/stucco layer was applied, a cover or seal dip comprising only the alumina slurry was applied and dried. The "rainbow" mold was dewaxed and fired by techniques known to those skilled in the art of investment casting. The total mold thickness after the dipping/stuccoing/drying procedures were completed was approximately 0.25 inches.

Mold Casting

The mold then was preheated prior to casting. The preheated mold was placed in a suitable induction coil contained in a DS/SC casting apparatus having a magnesia remelt crucible therein. The casting apparatus was then evacuated to less than on micron ($10^{-3}$ tort). The mold (positioned below the crucible) was concurrently heated to and held at 2700° F. to degas the mold. The mold was then heated 2775° F. prior to casting.

After mold preheating, an ingot of the baseline superalloy was induction melted in a magnesia crucible within the casting apparatus. The ingot had a composition, by weight, of 10% Co, 8.7% Ta, 5.9% W, 5.65% Al, 5.0% Cr, 3.0% Re, 1.9% Mo, 0.1% Hf and balance Ni. The ingot contained less than 5 parts per million by weight Y.

The alloy was heated to 250° F. above its melting point and then poured from the crucible into the preheated mold. The mold was then withdrawn from the hot zone at a rate effective to provide single crystal solidification of the molten alloy to produce a single crystal microstructure. At the completion of the withdrawal cycle, the mold was removed from the casting apparatus and allowed to cool to room temperature.

After the single crystal castings were removed from the mold, they were subjected to chemical, metallographic and oxidation testing.

Chemical analyses were performed to determine the concentrations of Y, Mg, Zr, Si and S. Table 2 sets forth the results of the analyses.

TABLE 2

CHEMICAL ANALYSIS OF TEST BARS CAST IN A "RAINBOW" MOLD

| TEST BAR NUMBER | FACECOAT SLURRY | FACECOAT STUCCO | TEST BAR LOCATION | ppm Y | Mg | Zr | Si | S |
|---|---|---|---|---|---|---|---|---|
| 1 | $ZrSiO_4$ | $Al_2O_3$ | Top | 20 | <10 | <50 | <1000 | 2 |
| | | | Bottom | 2 | <10 | <50 | <1000 | <1 |
| 2 | $ZrSiO_4$ | MgO | Top | 2 | 51* | 170* | <1000 | <1 |
| | | | Bottom | 2 | 140* | 160* | <1000 | 2 |
| 3 | $ZrSiO_4$ | $Y_2O_3$ | Top | 34 | <10 | 550* | 1300 | 2 |

TABLE 2-continued

| CHEMICAL ANALYSIS OF TEST BARS CAST IN A "RAINBOW" MOLD | | | | | | | | |
|---|---|---|---|---|---|---|---|---|
| TEST BAR | FACECOAT | | TEST BAR | ppm | | | | |
| NUMBER | SLURRY | STUCCO | LOCATION | Y | Mg | Zr | Si | S |
| | | | Bottom | 2 | <10 | 890* | 1900 | 10 |
| 4 | Mgo | $Al_2O_3$ | Top | 2 | <10 | <50 | <1000 | 2 |
| | | | Bottom | 2 | 10 | <50 | <1000 | 16 |
| 5 | MgO | MgO | Top | 2 | 10 | <50 | <1000 | 3 |
| | | | Bottom | 2 | 30 | <50 | <1000 | 6 |
| 6 | Mgo | $Y_2O_3$ | Top | 2 | 20 | <50 | <1000 | 1 |
| | | | Bottom | 2 | 20 | <50 | <1000 | 4 |
| 7 | $Y_2O_3$ | $Al_2O_3$ | Top | 3 | <10 | <50 | <1000 | 6 |
| | | | Bottom | 8 | <10 | <50 | <1000 | 3 |
| 8 | $Y_2O_3$ | MgO | Top | 2 | 20 | <50 | <1000 | 1 |
| | | | Bottom | 2 | 20 | <50 | <1000 | 8 |
| 9 | $Y_2O_3$ | $Y_2O_3$ | Top | 3 | 30 | <50 | <1000 | 2 |
| | | | Bottom | 3 | <10 | <50 | <1000 | 1 |
| | Starting Ingot*** | | | 4-5 | —** | <50 | <1000 | 7-12 |

*attributable to facecoat melting
**too low to analyze
***produced in a magnesia crucible Table 2 indicates that significant yttrium enrichment occurred only in castings #1 and #3. Zirconium enrichment occurred in castings #2 and #3 while high concentrations of silicon were observed only in casting #3. Magnesium enrichment was observed in castings #2, #4, #5, #6 and #8 where the melt was cast in contact with the magnesia-bearing facecoat. Magnesium concentrations of about 10 to about 30 ppm by weight were typical, although higher levels were observed in casting #2. As noted at the bottom of Table 2, the initial magnesium content of the ingot was too low to measure. Thus, enrichment of the castings #2, #4, #5, #6 and #8 appears to result from a reaction of the melt with the magnesia-bearing facecoat and/or the magnesia crucible. Sulfur levels in the castings were comparable to that of the starting ingot.

Figure 2:
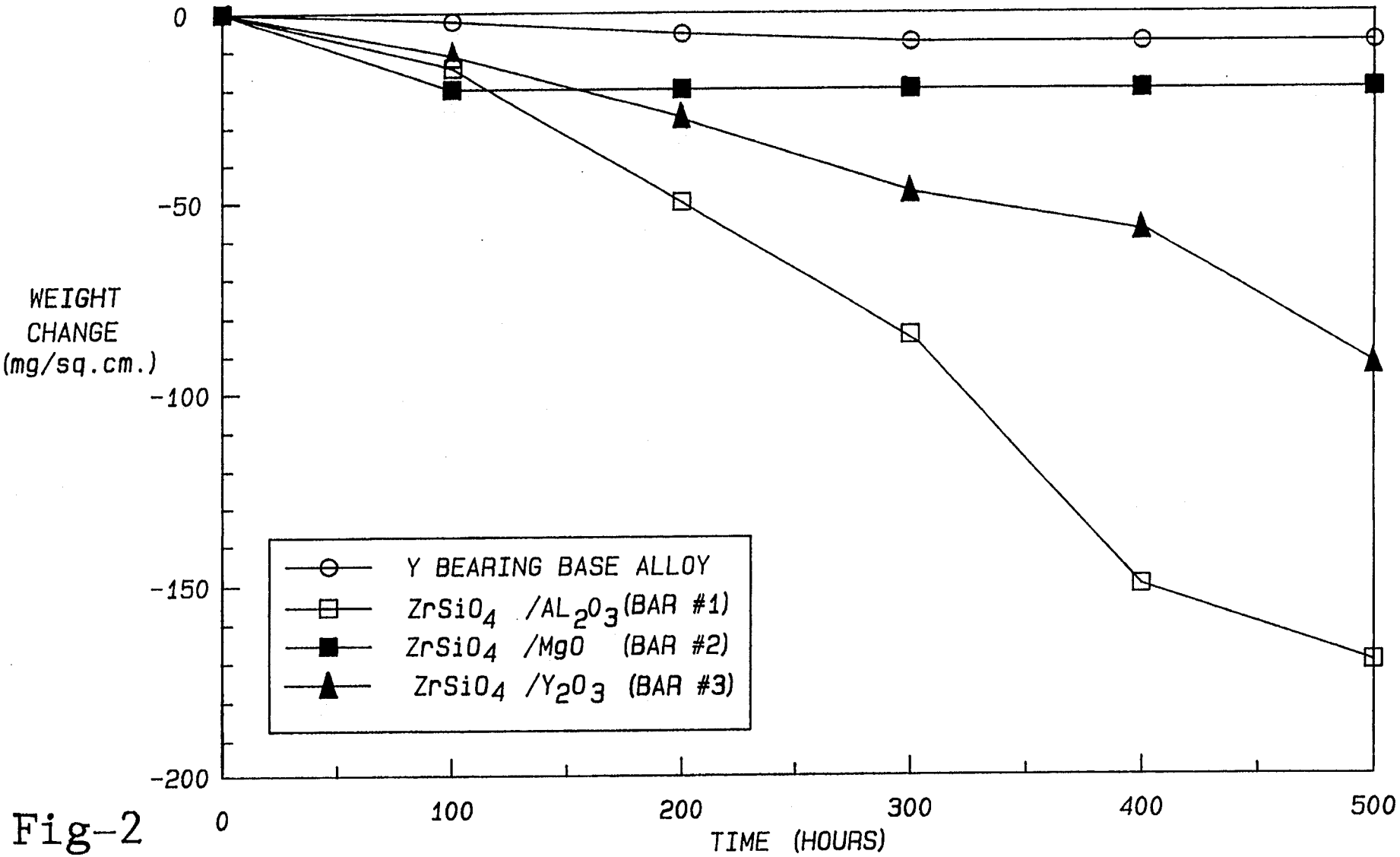
FIGS. 2–4 illustrate the effect of various mold facecoat compositions (given by slurry/stucco designations) on the oxidation resistance of a single crystal cast nickel based superalloy.
Figure 3:
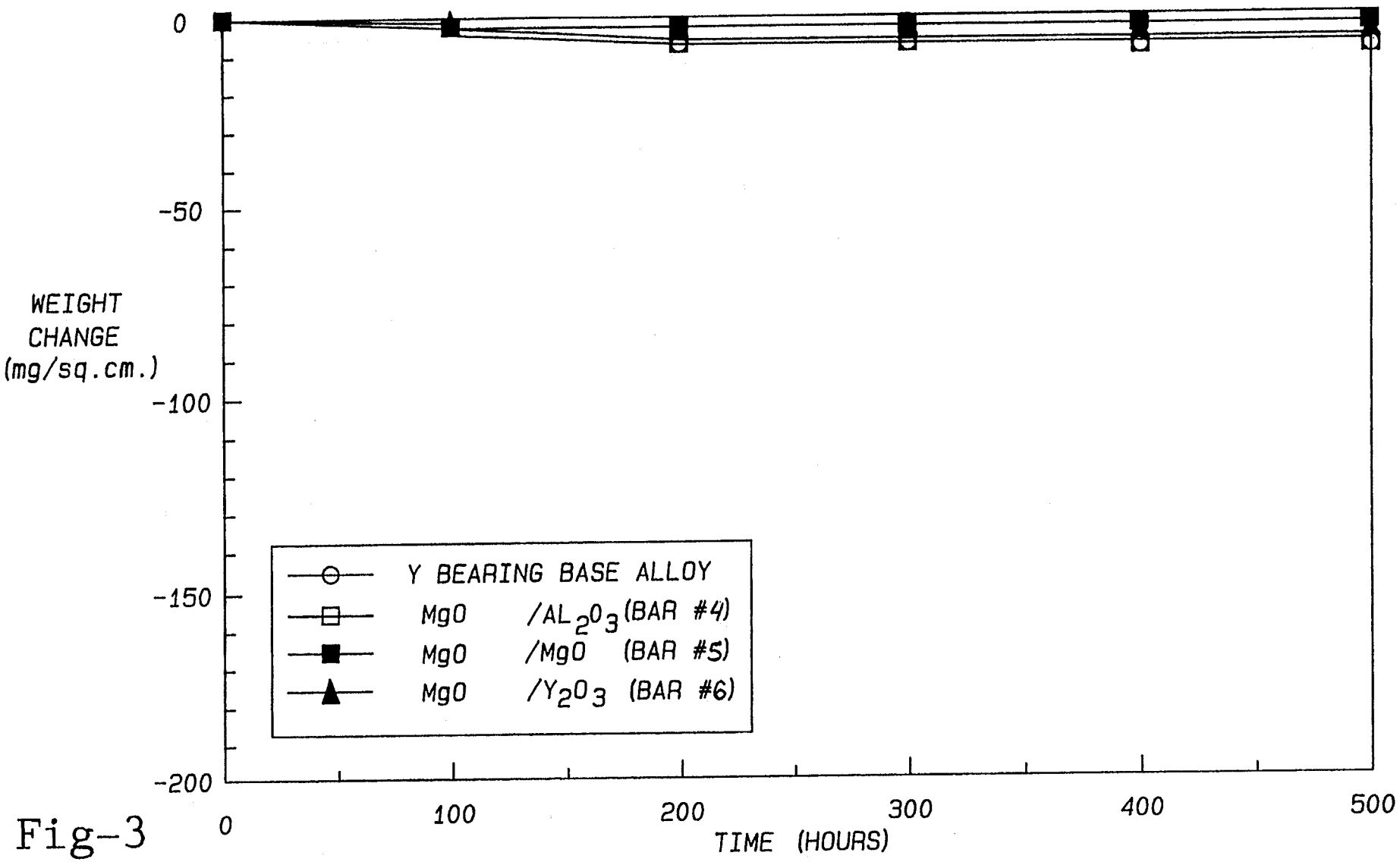
Figure 4:
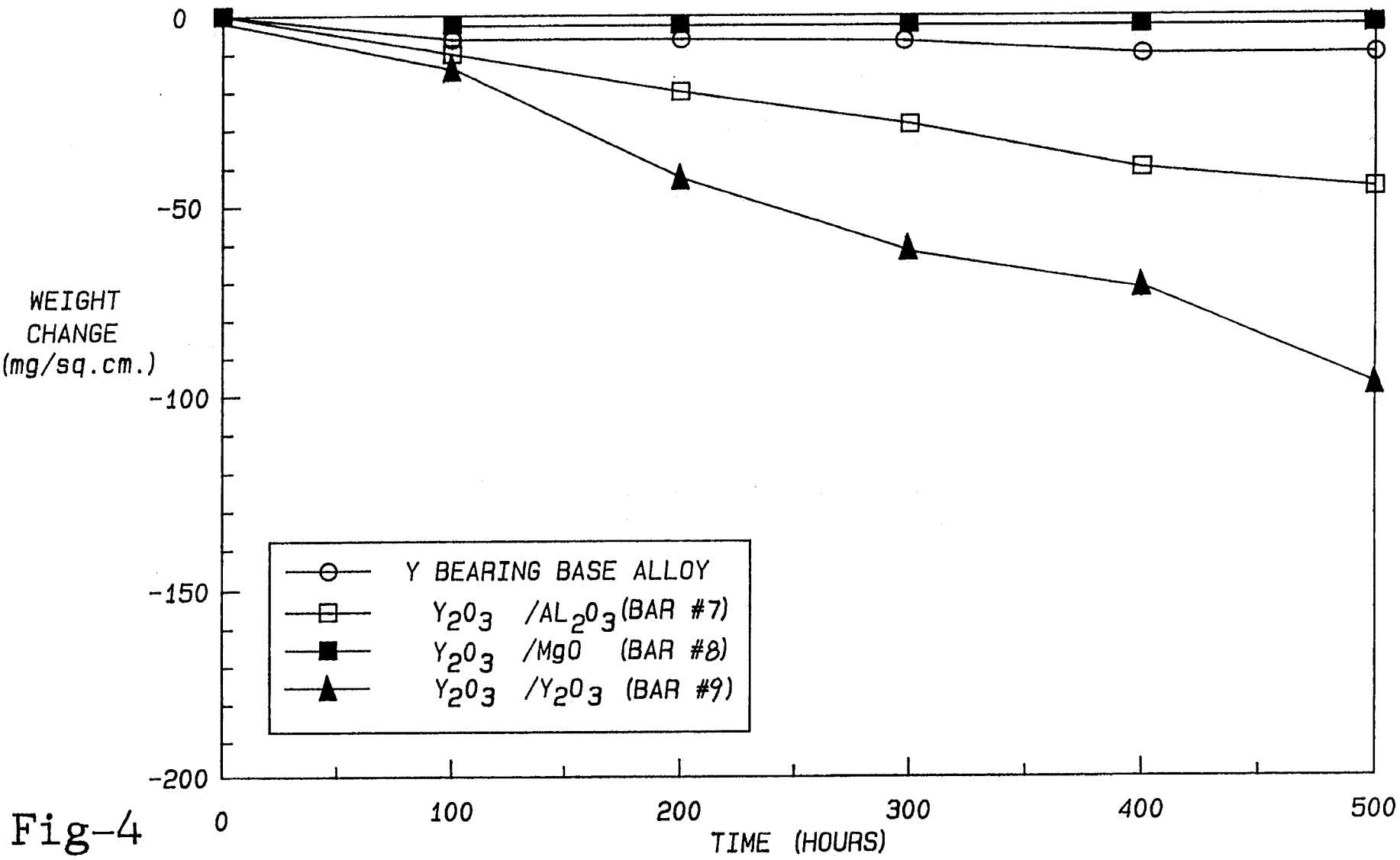

Cyclic oxidation testing was conducted to characterize the oxidation resistance of each single crystal casting. Cyclic oxidation testing was conducted on the as-cast single crystal test bars in repeating cycles of 2150° F. for 23 hours followed by 70° F. for one hour. The test was conducted for 504 hours (21 cycles). After each cycle, the castings were weighed and a graph of weight change (milligrams per square centimeter) versus time was prepared as FIGS. 2-4. Cyclic oxidation data obtained under identical test conditions is set forth for Y-bearing superalloy single crystal castings cast in a mold having a yttria facecoat under the same casting conditions as the other castings is shown in FIGS. 2-4 for comparison. The data indicate that the test bars cast so as to react with the magnesia-bearing mold facecoat exhibited oxidation resistance comparable to the Y-bearing superalloy, except for casting #2 which was cast against the zircon slurry and magnesia-bearing stucco facecoat.

The average oxidation rate (from 96 to 504 hours) for all of the test bars cast in contact with magnesia-bearing facecoats is substantially lower than the other test bars cast in contact with magnesia-free facecoats (see Table 3).

TABLE 3

| OXIDATION RATES (mg/sq. cm./hr) FOR TEST BARS CAST IN A "RAINBOW" MOLD | | | |
|---|---|---|---|
| | FACECOAT SLURRY | | |
| STUCCO | $ZrSiO_4$ | MgO | $Y_2O_3$ |
| $Al_2O_3$ | −0.395 | −0.003 | −0.077 |
| MgO | −0.006 | −0.002 | −0.004 |

TABLE 3-continued

| OXIDATION RATES (mg/sq. cm./hr) FOR TEST BARS CAST IN A "RAINBOW" MOLD | | | |
|---|---|---|---|
| | FACECOAT SLURRY | | |
| STUCCO | $ZrSiO_4$ | MgO | $Y_2O_3$ |
| $Y_2O_3$ | −0.216 | −0.005 | −0.203 |

While the sulfur concentration in castings #4, #5, #6 and #8 is comparable to castings #1, #3, #7 and #9, the superior oxidation resistance of the former is believed to be due to the magnesium tying up the sulfur as innocuous compounds. For example, thermodynamic data indicate that Mg can tie up S as MgS. This would prevent sulfur from diffusing to the alumina scale/base metal interface and causing gross exfoliation. The relatively poor oxidation resistance of casting #2 (see FIG. 2) is attributed to a reaction between the zircon in the facecoat and the magnesia stucco at the casting temperature, which causes facecoat melting and resultant contamination of the casting. Facecoat melting in this instance is believed to result from the formation of an eutectic phase between zircon and magnesia at the elevated casting temperatures. Facecoat melting can be avoided by using a facecoat slurry other than zircon since no adverse reactions were observed when magnesia stucco was used in conjunction with magnesia or yttria dip (slurry) layers at the casting temperature. The magnesia or yttria slurry/magnesia stucco facecoats produced castings with improved oxidation resistance and excellent surface quality when the alumina slurry/stucco back-up layer (i.e., the third alumina slurry/stucco layer described above) was present as a barrier layer to prevent adverse reaction between outer back-up slurry/stucco layers containing zircon and the magnesia-bearing facecoat.

Figure 8B:
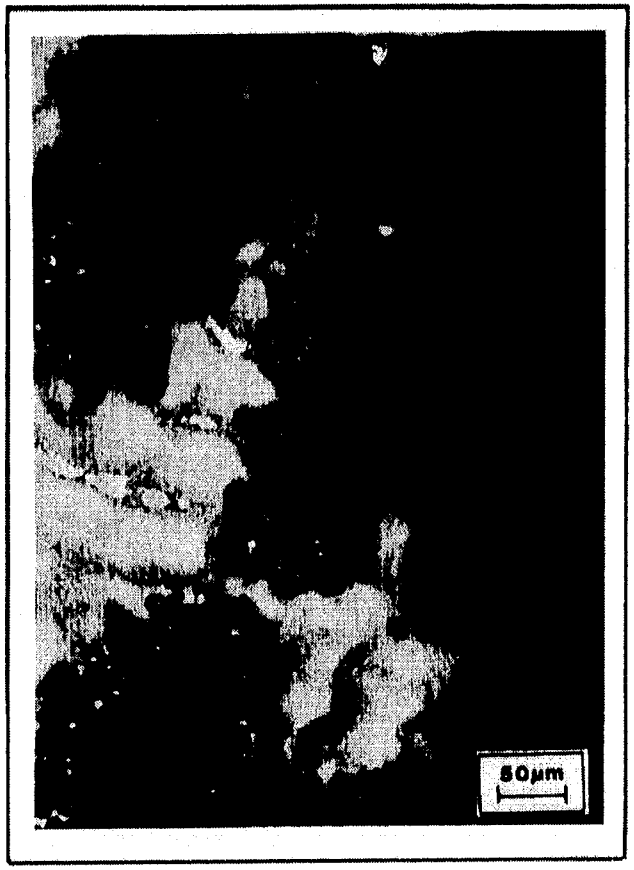
FIGS. 8*a*–8*c*, 9*a*–9*c* and 10*a*–10*c* illustrate the reactivity and surface roughness of the baseline superalloy cast using various mold facecoat compositions.
Figure 8A:
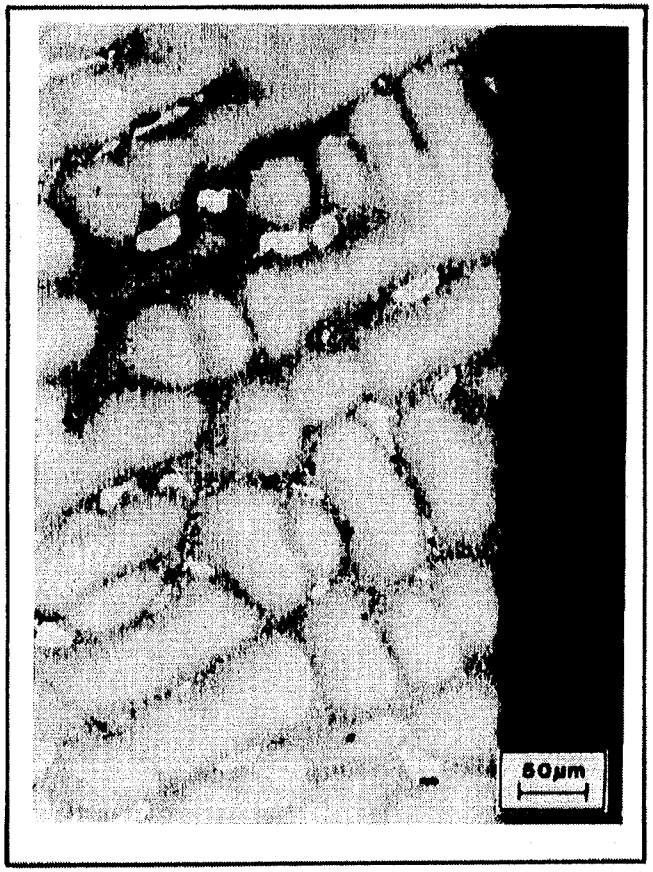
Figure 9A:
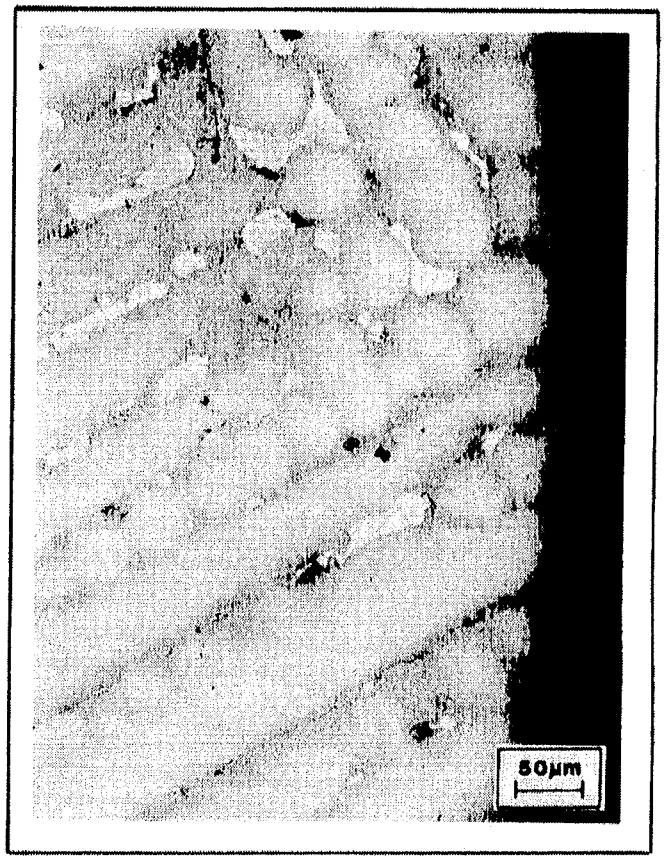
Figure 8C:
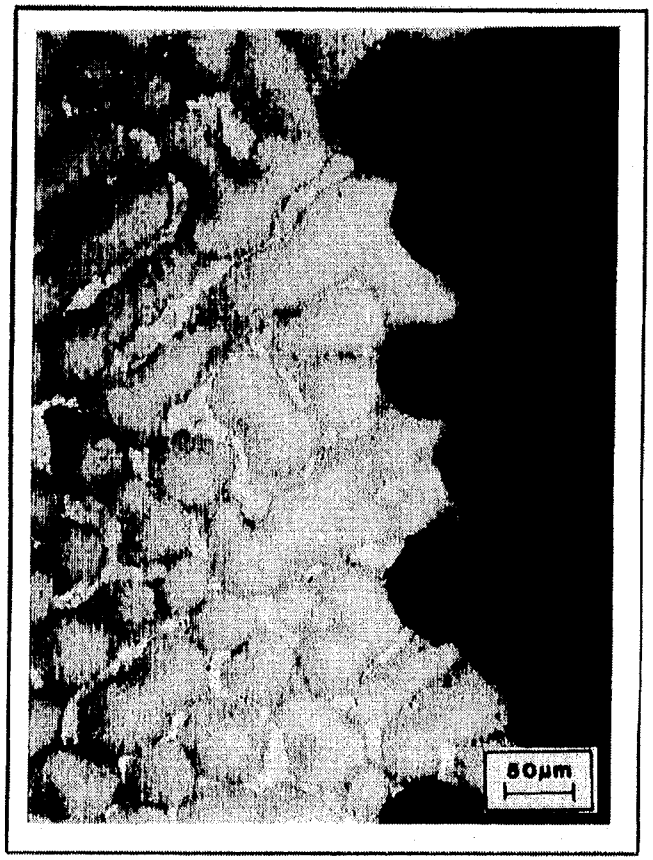
Figure 9C:
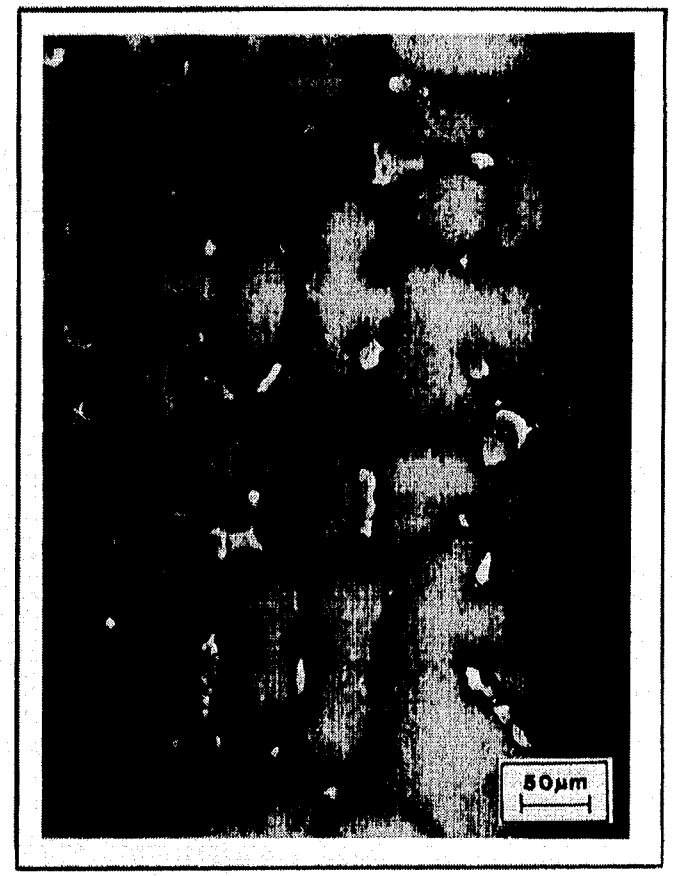
Figure 9B:
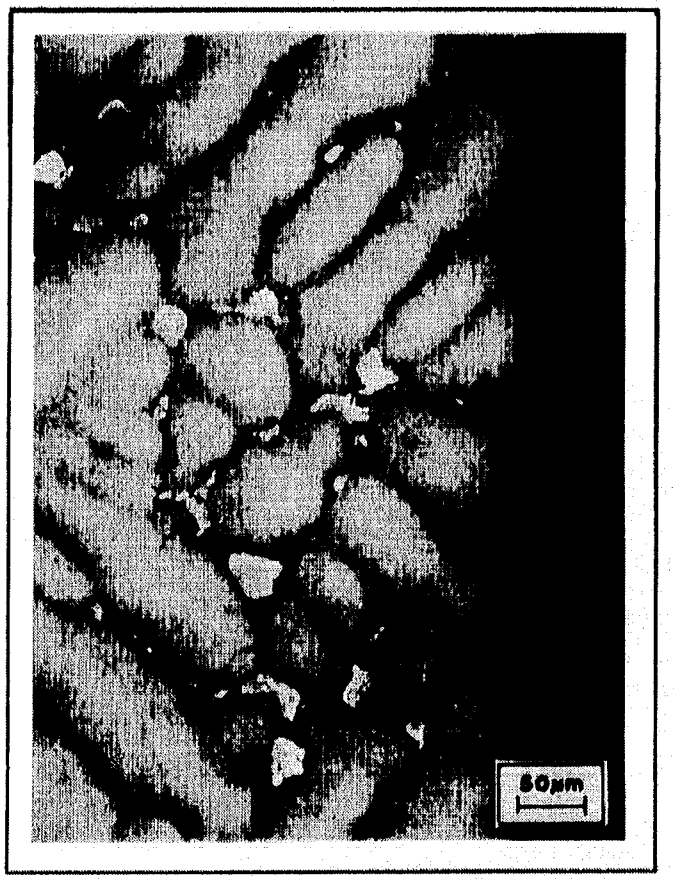
Figure 10B:
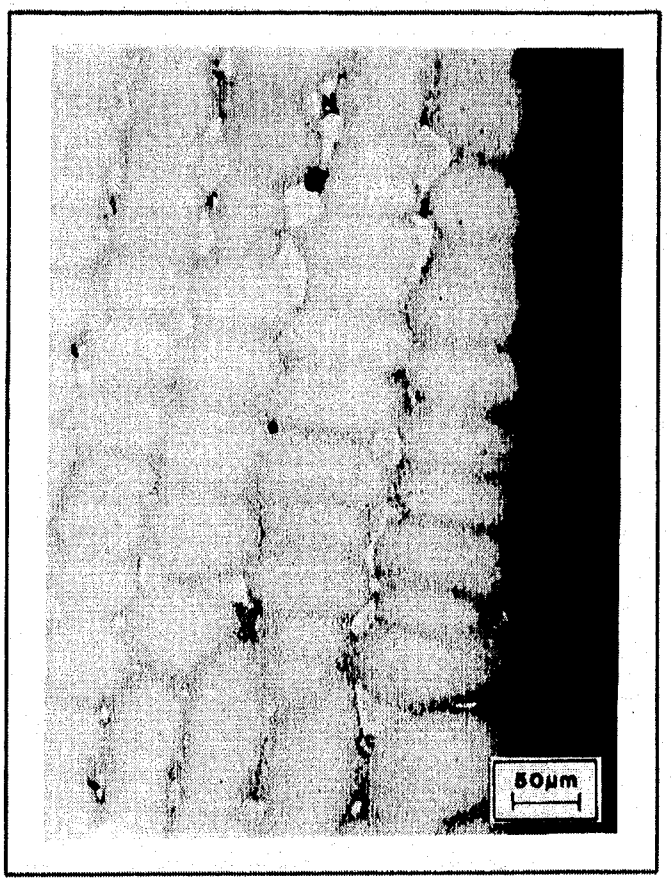
Figure 10A:
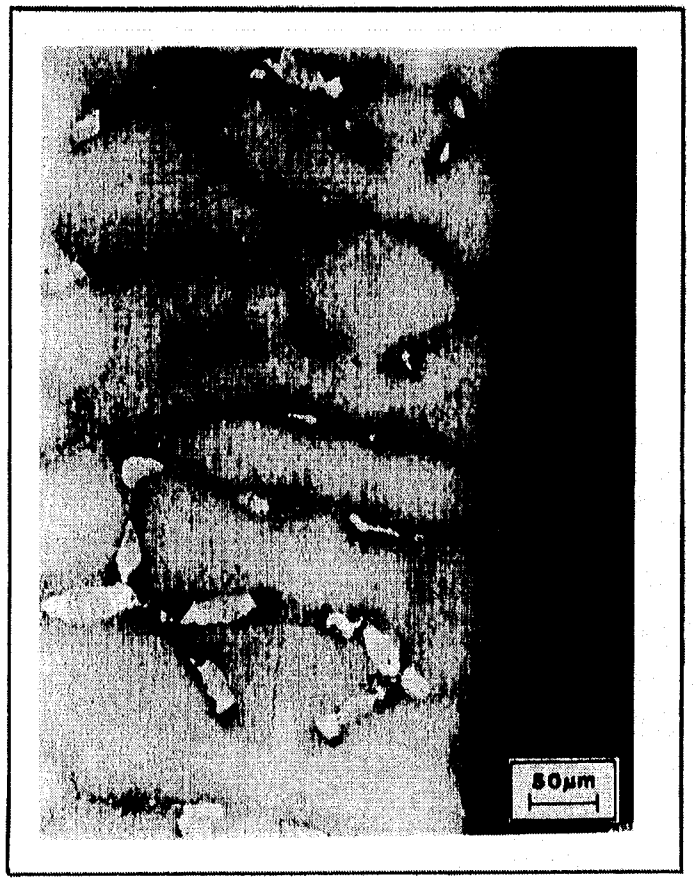
Figure 10C:
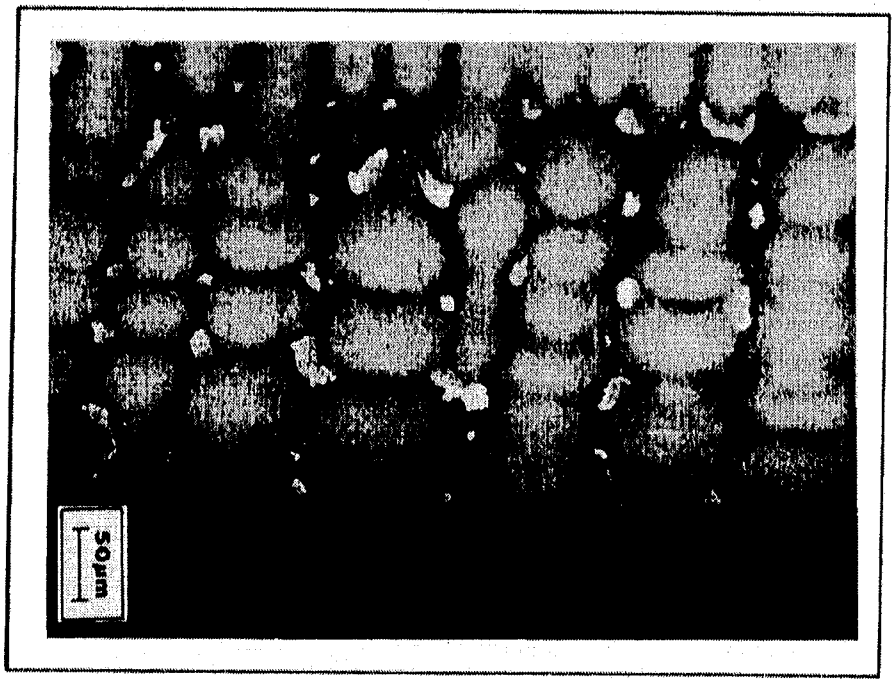

Metallographic examinations showed that, except for casting #2 and #3, the surface quality between the baseline superalloy and the magnesia-bearing facecoat (castings #4,#5,#6 and #8) is comparable to the surface quality of the baseline superalloy with the zircon facecoat. FIGS. 8-10 illustrate the surface features observed. FIG. 8*a* illustrates the surface quality of the test bar cast against the zircon facecoat. FIGS. 8*b* and 8*c* illustrate the surface quality of the test bars where there was facecoat melting (FIG. 8*b*) and excessive reaction (FIG. 8*c*) with the alloy. FIGS. 9*a*-9*c* illustrate the surface quality of test bars cast against the magnesia facecoat slurry. FIGS. 10a–10c show the surface quality of the test bars cast against the yttria facecoat slurry.

Crucible Effects

In the above-described casting trials, the baseline superalloy ingot was remelted in a magnesia crucible in the aforementioned DS/SC casting apparatus. Comparative casting tests using alumina, zirconia and magnesia crucibles were performed as described below. In particular, nine single crystal test molds (three with a zircon facecoat, three with an alumina facecoat and three with a yttria facecoat) were prepared using a dipping/stuccoing/drying procedure similar to that described in detail hereinabove. Each facecoat was backed by a conventional shell system. Each test mold included ten mold cavities of 0.5 inch diameter and 6 inches length, each mold cavity being connected to the mold bottom by a single crystal starter. Each test mold was preheated prior to casting in the manner described, above.

The baseline superalloy ingot was melted in either alumina, zirconia or a magnesia crucible in the DS/SC casting apparatus. The baseline superalloy was cast from the crucibles into the respective test molds, which were then withdrawn from the furnace hot zone at a rate which permitted single crystal solidification of the molten alloy.

Table 4 illustrates the results of chemical analyses of the castings produced using the different remelting crucibles.

TABLE 4

CHEMICAL ANALYSIS OF TEST BARS AND STARTER BLOCKS

| MOLD NUMBER | FACECOAT SLURRY/STUCCO | CRUCIBLE | LOCATION | ppm Y | ppm Mg | ppm S |
|---|---|---|---|---|---|---|
| 1 | $ZrSiO_4/Al_2O_3$ | $ZrO_2$ | Bar Top | 2 | <10 | 1 |
| | | | Bar Bottom | 2 | <10 | <1 |
| | | | Starter | 13 | <10 | <1 |
| 2 | | $Al_2O_3$ | Bar Top | 2 | <10 | 8 |
| | | | Bar Bottom | 2 | <10 | 8 |
| | | | Starter | 3 | <10 | <1 |
| 3 | | MgO | Bar Top | 2 | 50 | 4 |
| | | | Bar Bottom | 2 | <10 | <4 |
| | | | Starter | 3 | <10 | <1 |
| 4 | $Al_2O_3/Al_2O_3$ | $ZrO_2$ | Bar Top | 2 | 10 | 7 |
| | | | Bar Bottom | 3 | <10 | <1 |
| | | | Starter | 2 | <10 | 12 |
| 5 | | $Al_2O_3$ | Bar Top | 3 | <10 | 5 |
| | | | Bar Bottom | 2 | 10 | 2 |
| | | | Starter | 3 | <10 | 6 |
| 6 | | Mgo | Bar Top | 2 | <10 | <1 |
| | | | Bar Bottom | 2 | <10 | 4 |
| | | | Starter | 3 | <10 | 2 |
| 7 | $Y_2O_3/Al_2O_3$ | $ZrO_2$ | Bar Top | 2 | <10 | 1 |
| | | | Bar Bottom | 2 | <10 | <1 |
| | | | Starter | 2 | <10 | 5 |
| 8 | | $Al_2O_3$ | Bar Top | 2 | <10 | 1 |
| | | | Bar Bottom | 3 | <10 | <1 |
| | | | Starter | 3 | <10 | 2 |
| 9 | | Mgo | Bar Top | 2 | <10 | 3 |
| | | | Bar Bottom | 2 | <10 | <1 |
| | | | Starter | 29 | <10 | 2 |

Figure 5:
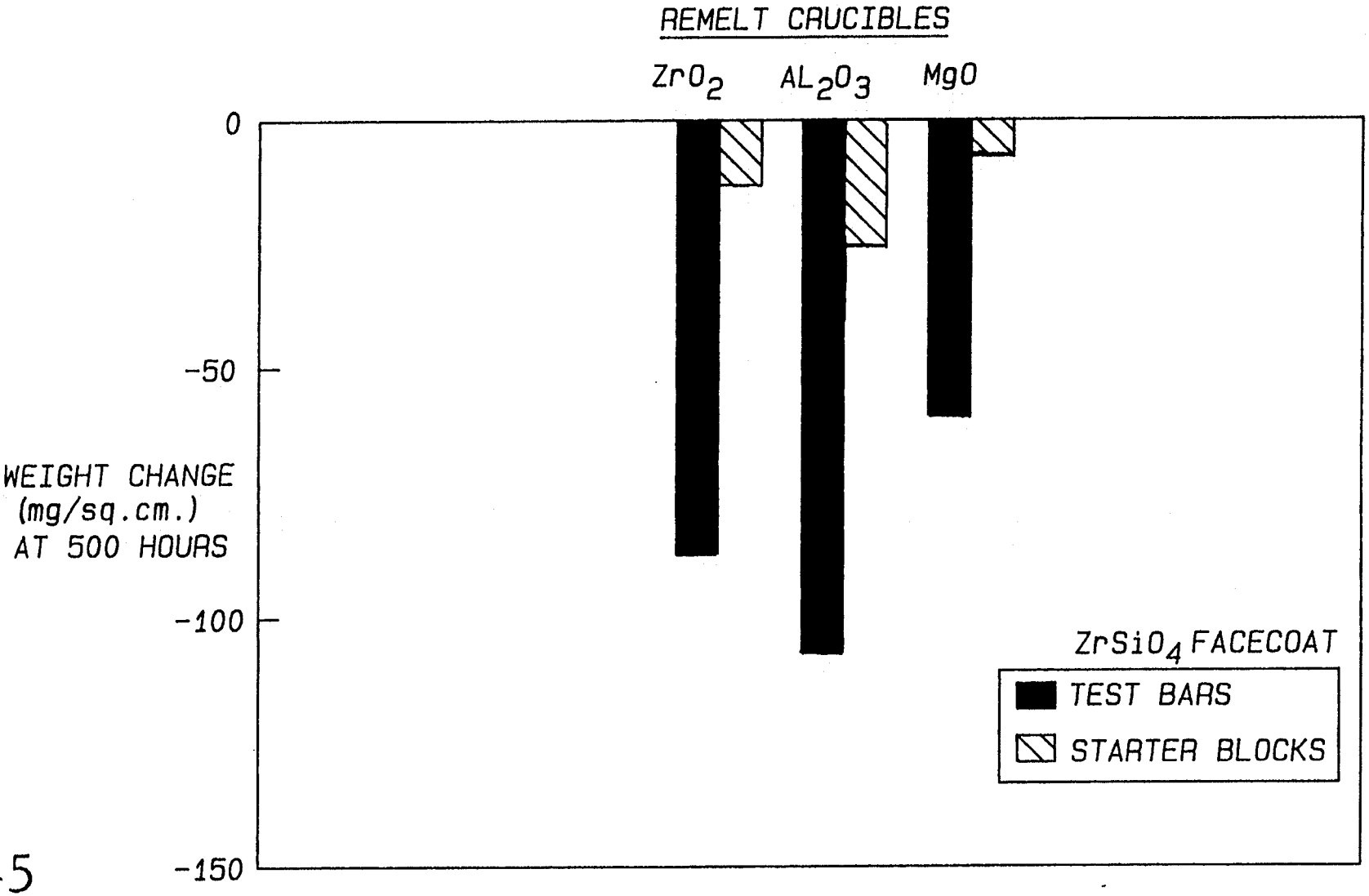
FIGS. 5–7 illustrate the effect of various remelt crucible compositions on the oxidation resistance of a single crystal cast nickel based superalloy.
Figure 6:
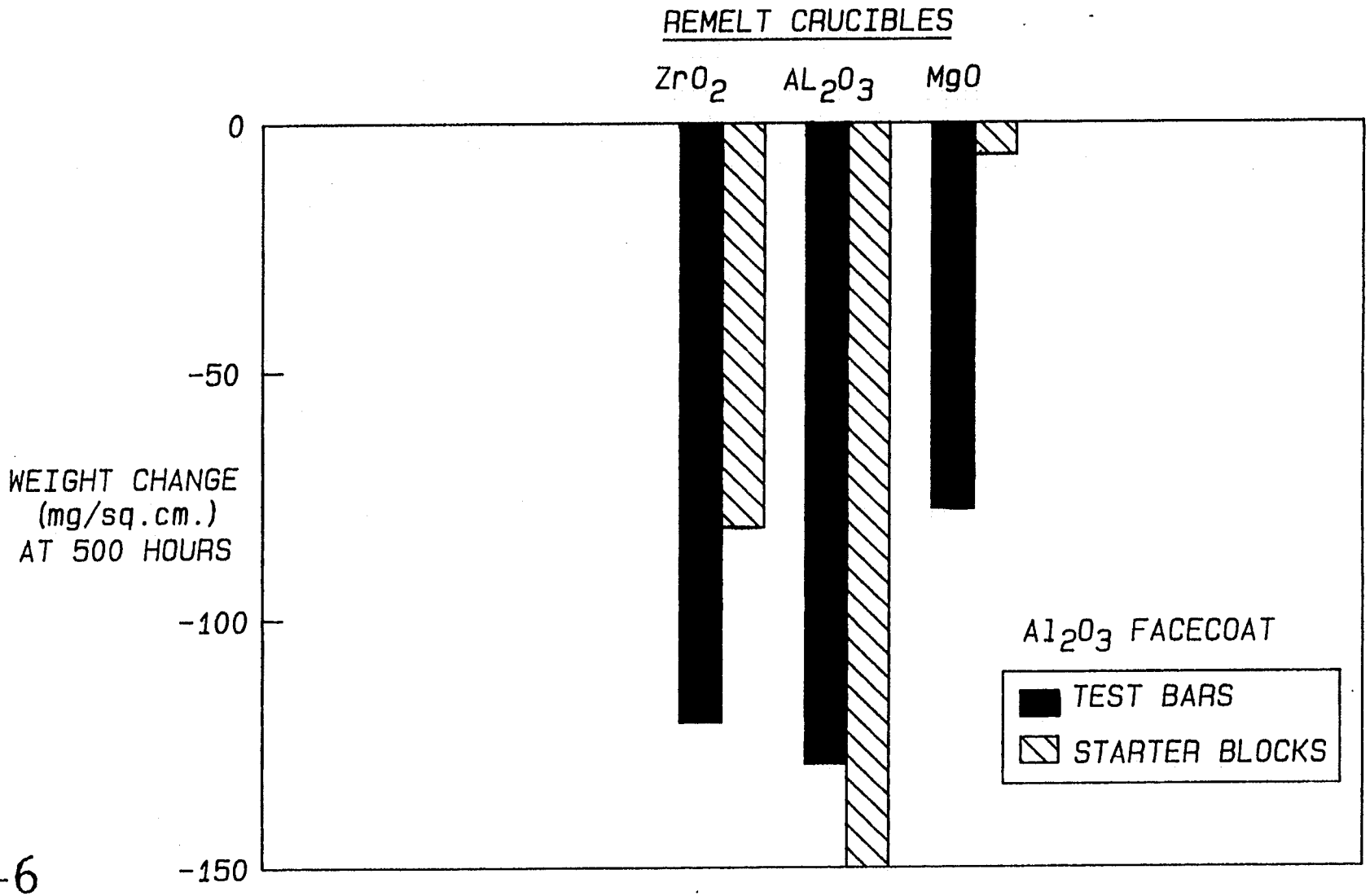
Figure 7:
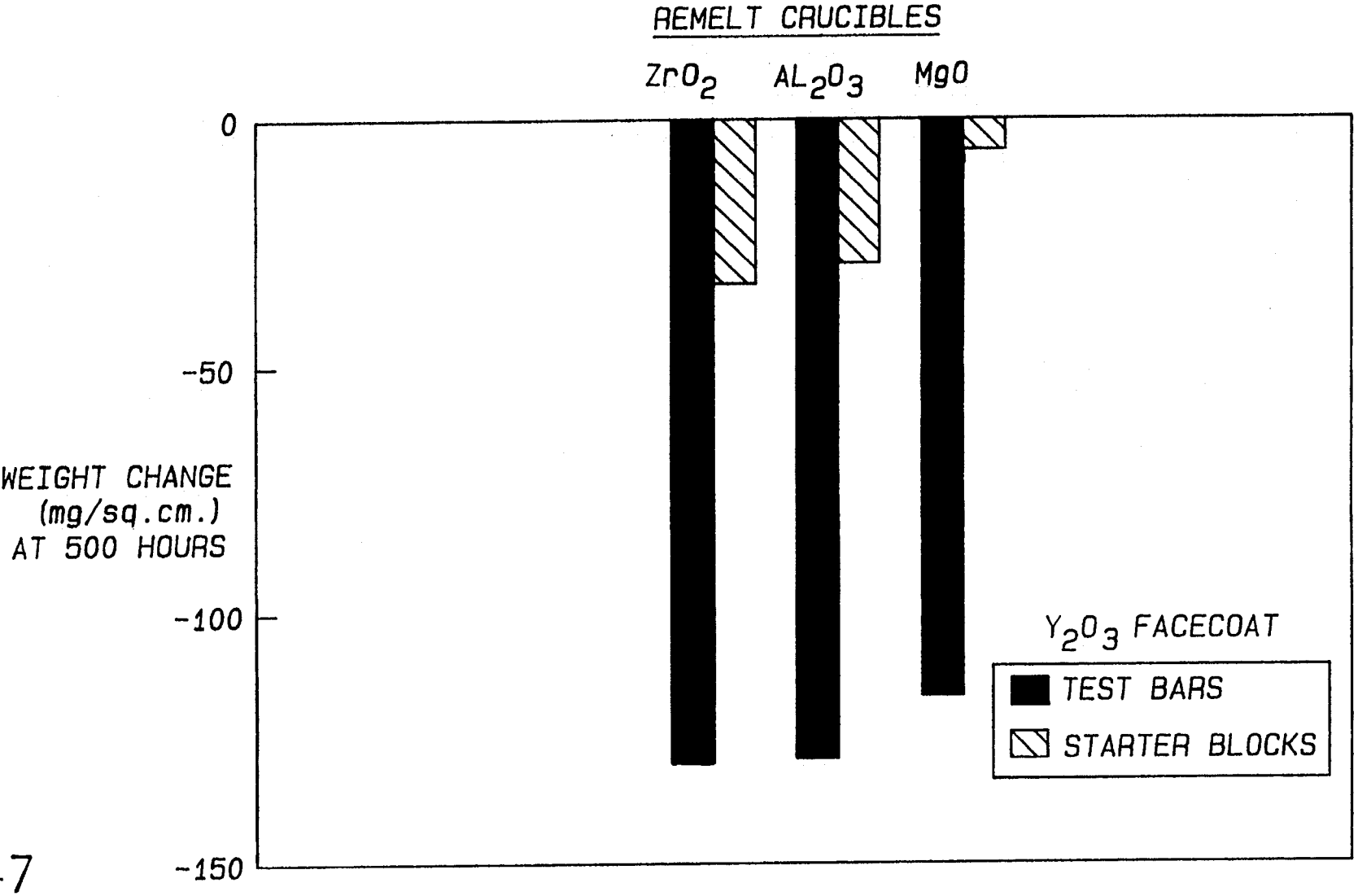

Table 4 indicates that the contents of Y, Mg, and S were comparable in the test bar castings and in the starter blocks. The concentrations of the major alloying elements (e.g., Co, Ni, Ta, etc.) all met the production specifications for the baseline alloy. FIGS. 5–7 illustrate the oxidation behavior of starter blocks and test bar castings when tested in accordance with the oxidation test described in detail hereinabove.

With one exception, the starter blocks exhibited markedly superior oxidation resistance than the test bar castings (which remained molten over a much longer period of time). This data suggests that oxidation resistance of the baseline superalloy is sensitive to contact time between the molten superalloy and the mold facecoat ceramic.

When magnesia crucibles were used, the weight change of the starter blocks in the oxidation tests was 10 to 20 times lower than the test bar castings solidified in the associated mold. Moreover, a slight improvement in oxidation resistance was observed in test bar castings melted and poured from magnesia crucibles. This data suggests that oxidation resistance is also sensitive to the crucible composition. The superior oxidation resistance of the starter blocks and the test bar castings cast from magnesia crucibles could be the result of chemical refining and/or Mg enrichment prior to casting, although no significant differences were observed in the compositions of the starter blocks and test bar castings as shown in Table 4. In practicing the present invention, the use of magnesia crucibles is thus preferred as a result of the recognized benefit of such melting (in magnesia crucibles) on the oxidation resistance of the test bar castings/starter blocks. As mentioned above, the molten superalloy can be solidified in a mold having a magnesia-bearing mold facecoat to render innocuous any sulfur pick up which may occur subsequent to melting during the casting operation.

Although the present invention has been described in detail hereinabove as being practiced by reacting the molten superalloy with a magnesium-bearing mold slurry and/or stucco of the facecoat, the invention can be practiced using one or more facecoat layers where the magnesium-bearing ceramic is present in desired proportions with another ceramic material.

The ceramic shell molds described hereinabove for use in practicing the invention are generally porous such that acceptable results (i.e., Mg enrichment of the casting) can be achieved even if the Mg bearing slurry and/or stucco is not at the surface of the mold which contacts the molten metal. For example, the invention can be practiced using a shell mold having a first slurry/stucco layer that is not Mg-bearing but having a second slurry/stucco layer that is Mg-bearing.

Moreover, although the invention has been described with respect to casting the molten superalloy in contact with a magnesium-bearing mold facecoat, the invention envisions reacting the molten superalloy with components other than the mold facecoat, such as a mold core which may be used in casting of hollow components (e.g., hollow turbine blades). Moreover, other processing components, such as crucibles, tundishes, weirs, dams, filters, melt stirring tools, and other melt treating and handling tools may comprise the magnesium-bearing ceramic to this same end.

Figure 11A:
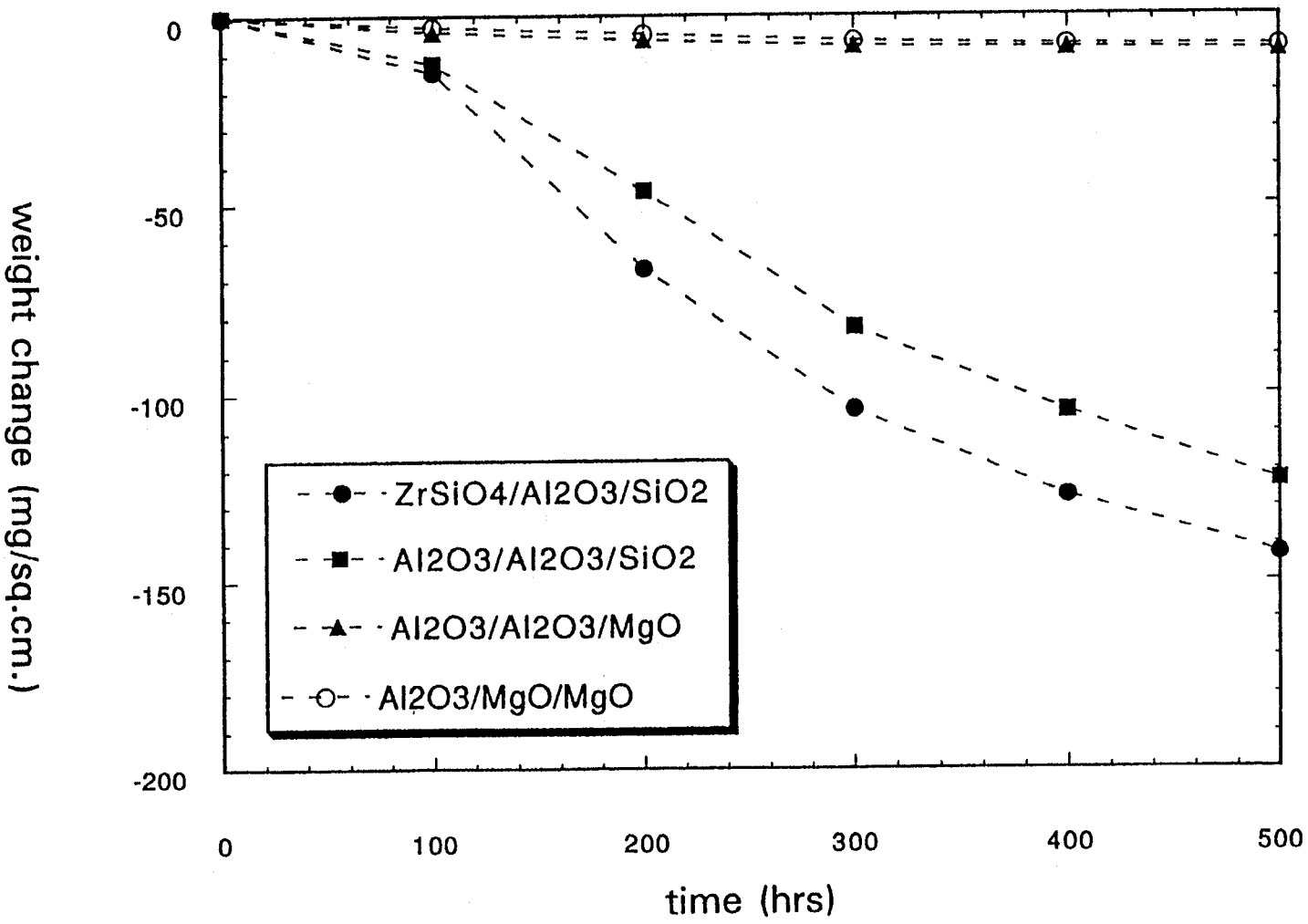
FIGS. 11*a*–11*c* illustrate the effect of magnesia cores on the oxidation resistance of a single crystal cast nickel based superalloy.
Figure 11B:
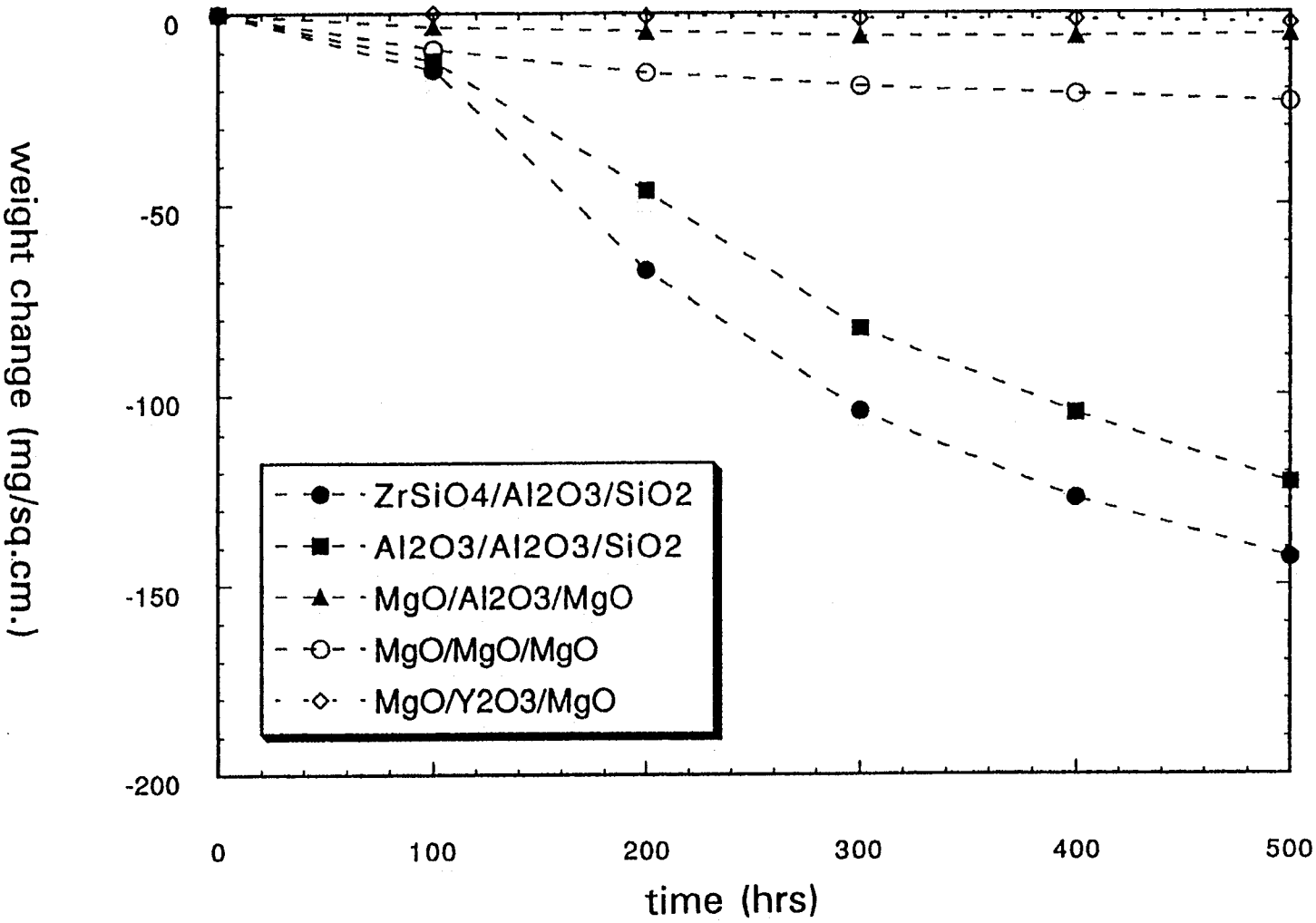
Figure 11C:
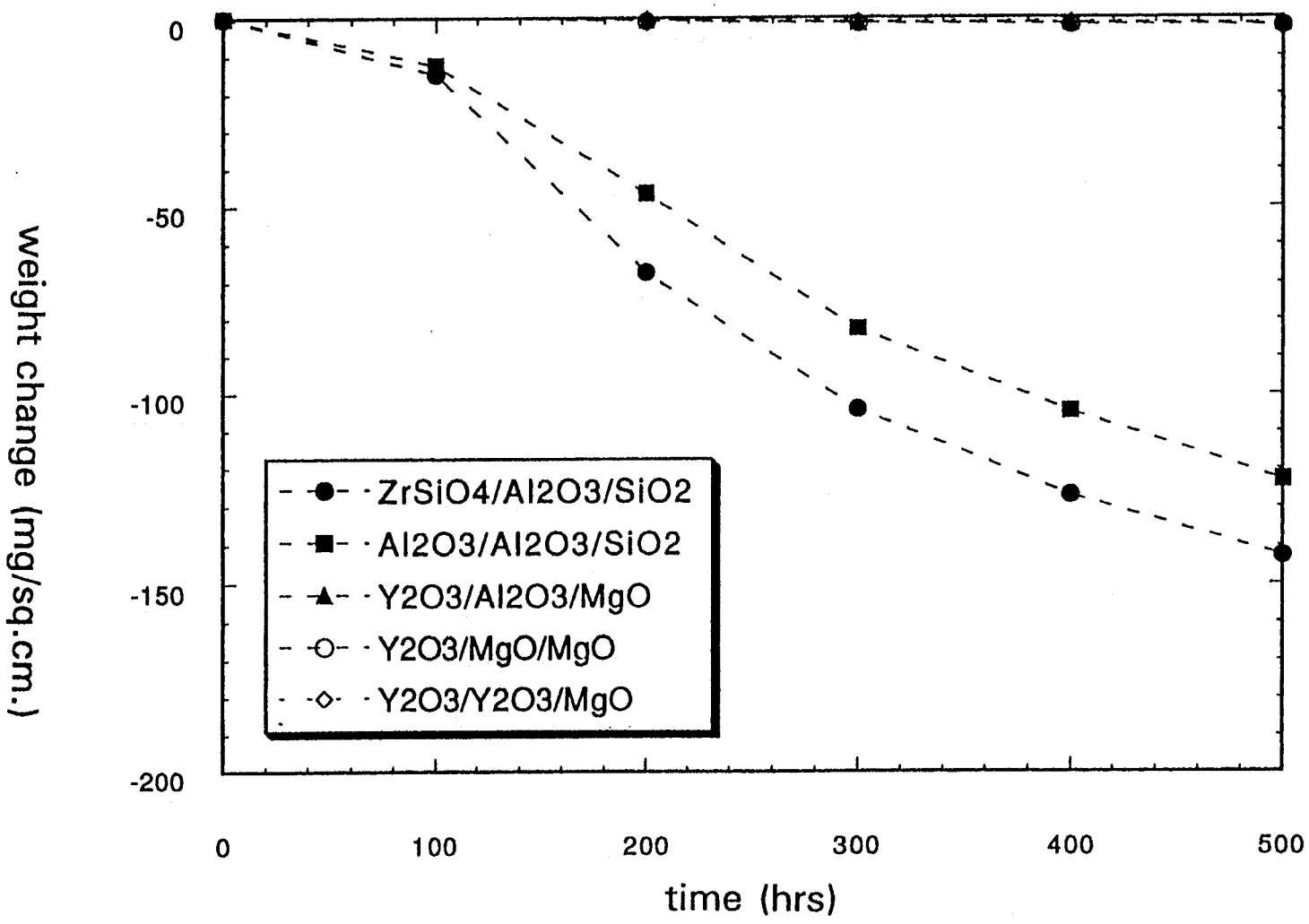

FIGS. 11*a*–11*c* illustrate the effect of the presence of a rectangular-shaped magnesia core in a shell mold on the oxidation resistance of hollow, rectangular-shaped test bars cast in the molds. The cores and molds were dimensioned to yield hollow single crystal castings having a nominal wall thickness of 0.060 inch. In particular, ceramic shell molds were prepared in the same manner and using the same materials described hereinabove about a wax pattern that included a magnesia core therein such that the magnesia core remained in the shell mold cavity after pattern removal. The data points she in FIGS. 11*a*–11*c* are designated by the particule facecoat slurry/facecoat stucco/core materials used. The aforementioned baseline superalloy was melted, poured and solidified in the molds in the manner described hereinabove. It is apparent that the presence of the magnesia core substantially improved the oxidation resistance of the hollow test bars a compared to that exhibited by test bars cast in conventional mold systems (i.e., $Al_2O_3$ facecoat slurry/$Al_2O_3$ facecoat stucco/$SiO_2$ core and $ZrSiO_4$ facecoat slurry/$Al_2O_3$ facecoat stucco/$SiO_2$ core)

Table 5 illustrates the results of chemical analyses (parts per million by weight) of the hollow test bars whose oxidation resistance is depicted in FIGS. 11*a*–11*c*. Magnesium enrichment was observed in the test bars cast using magnesia cores. Moreover, sulfur contents were generally lower in the test be cast with magnesia cores than in the test bars cast using conventional $SiO_2$ cores.

TABLE 5

Chemical Analyses of Test Bars Cast Using MgO Cores

| FACECOAT SLURRY | FACECOAT STUCCO | CORE | LOCATION ON CASTING | Y | Mg | Zr | Si | S |
|---|---|---|---|---|---|---|---|---|
| $ZrSiO_4$ | $Al_2O_3$ | $SiO_2$ | top | 2 | <10 | <50 | <1000 | 13 |
| | | | bottom | 1 | <10 | <50 | <1000 | 10 |
| $Al_2O_3$ | $Al_2O_3$ | $SiO_2$ | top | 2 | <10 | <50 | <1000 | 26 |
| | | | bottom | 2 | <10 | <50 | <1000 | 15 |
| $Al_2O_3$ | $Al_2O_3$ | MgO | top | 2 | 10 | <50 | <1000 | 9 |
| | | | bottom | 2 | 10 | <50 | <1000 | 12 |
| $Al_2O_3$ | MgO | MgO | top | 2 | 40 | <50 | <1000 | <1 |
| | | | bottom | 2 | 30 | <50 | <1000 | 4 |
| MgO | $Al_2O_3$ | MgO | top | 2 | <10 | <50 | <1000 | 13 |
| | | | bottom | <1 | 20 | <50 | <1000 | 8 |
| MgO | MgO | MgO | top | 2 | 70 | <50 | <1000 | <1 |
| | | | bottom | 2 | 20 | <50 | <1000 | 11 |
| MgO | $Y_2O_3$ | MgO | top | 2 | 20 | <50 | <1000 | <1 |
| | | | bottom | 3 | <10 | <50 | <1000 | 10 |
| $Y_2O_3$ | $Al_2O_3$ | MgO | top | 8 | 30 | <50 | <1000 | <1 |
| | | | bottom | 3 | <10 | <50 | <1000 | 14 |
| $Y_2O_3$ | MgO | MgO | top | 4 | 30 | <50 | <1000 | 1 |
| | | | bottom | 2 | <10 | <50 | <1000 | 8 |
| $Y_2O_3$ | $Y_2O_3$ | MgO | top | 7 | 40 | <50 | <1000 | <1 |
| | | | bottom | 2 | <10 | <50 | <1000 | 6 |

Furthermore, the present invention contemplates that calcium -bearing ceramic material(s) (e.g., calcia-containing ceramics) could be used in lieu of or in addition to the magnesium-bearing ceramics described above to introduce Ca into the superalloy to provide similar benefits to oxidation resistance of the superalloy. The calcium-bearing material(s) can be used in remelt crucibles, mold facecoats, cores, tundishes, stirring tools, etc in the manner described above for the magnesium-bearing ceramic materials.

While the invention has been described in terms of specific embodiments thereof, it is not intended to be limited thereto but rather only to the extent set forth hereafter in the following claims.

We claim:

1. A method of improving the oxidation resistance of a superalloy, comprising reacting the superalloy in the molten state with a magnesium or calcium-bearing ceramic material to introduce magnesium or calcium into the superalloy in an amount effective to increase its oxidation resistance.

2. The method of claim 1 wherein the superalloy in the molten state is reacted with the ceramic material by casting the superalloy melt in contact with a mold component comprising the ceramic material.

3. The method of claim 1 wherein the magnesium-bearing material comprises magnesia, magnesium silicate, magnesium aluminate, magnesium zirconate, or mixtures or solid solutions thereof.

4. The method of claim 1 wherein the calcium-bearing ceramic material comprises calcia.

5. The method of claim 1 wherein a nickel, cobalt, iron, or nickel/iron based superalloy is melted and contacted with the ceramic material.

6. The method of claim 1 wherein the superalloy is substantially free of yttrium or other rare earth elements.

7. A method of improving the oxidation resistance of a superalloy component cast from a superalloy melt, comprising reacting the superalloy melt with a magnesium or calcium-bearing ceramic material during the casting process to introduce magnesium or calcium into the superalloy in an amount effective to increase the oxidation resistance of the cast superalloy component.

8. The method of claim 7 wherein the cast superalloy component is a turbine blade or vane.

9. The method of claim 7 wherein the superalloy is substantially free of yttrium and other rare earth elements.

10. The method of claim 7 wherein the melt is reacted with a magnesium or calcium-bearing mold facecoat slurry.

11. The method of claim 7 wherein the melt is reacted with a magnesium or calcium-bearing mold facecoat stucco.

12. The method of claim 7 wherein the melt is reacted with a magnesium or calcium-bearing mold core.

13. The method of claim 7 wherein the molten superalloy is contained in a magnesia or calcia based crucible.

14. The method of claim 10 or 11 wherein the facecoat comprises magnesia, magnesium silicate, magnesium aluminate, magnesium zirconate, or mixtures or solid solutions thereof.

15. The method of claim 12 wherein the core comprises magnesia, magnesium silicate, magnesium aluminate, magnesium zirconate, or mixtures or solid solutions thereof.

16. The method of claim 10 wherein the calcium-bearing ceramic material comprises calcia.

17. The method of claim 7 wherein the superalloy in the molten state is contacted with the ceramic material by handling the superalloy melt with a magnesium or calcium bearing ladle, tundish, filter, or pour cup.

18. The method of claim 7 wherein a nickel, cobalt, iron, or nickel/iron based superalloy is melted and contacted with the ceramic material.

19. The method of claim 7 wherein contact occurs during a directional or single crystal solidification casting process.

20. The method of claim 7 wherein contact occurs during an equiaxed solidification casting process.

21. A method for making an oxidation resistant nickel base superalloy having a single crystal microstructure, comprising the steps of preparing a casting mold which comprises a plurality of slurry layers and stucco layers, wherein at least one of said layers includes magnesia; melting the superalloy; pouring the melted superalloy into the mold, wherein the melted superalloy reacts with the magnesia layer such that the superalloy becomes enriched with magnesium in an amount effective to increase its oxidation resistance; and solidifying the magnesium enriched superalloy in the mold at a rate sufficient to produce a single crystal superalloy.

22. A method of making a hollow oxidation resistant nickel base superalloy having a single crystal microstructure, comprising the step of solidifying the superalloy in a mold having a magnesia-bearing core disposed therein to introduce magnesium into the superalloy in an amount effective to increase its oxidation resistance when solidified.

* * * * *